United States Patent [19]

Gruhn

[11] Patent Number: 4,746,767

[45] Date of Patent: May 24, 1988

[54] SHIELDED ELECTRICAL CABLE CONSTRUCTION

[75] Inventor: Joel D. Gruhn, Hickory, N.C.

[73] Assignee: Neptco Incorporated, Pawtucket, R.I.

[21] Appl. No.: 19,679

[22] Filed: Feb. 27, 1987

[51] Int. Cl.[4] ..... H01B 7/34

[52] U.S. Cl. ..... 174/36; 174/105 R; 174/106 R; 174/107; 174/109

[58] Field of Search ..... 174/36, 105 R, 106 R, 174/109, 107

[56] References Cited

U.S. PATENT DOCUMENTS

| | | | |
|---|---|---|---|
| 2,852,423 | 9/1958 | Bassett, Jr. | 174/36 |
| 3,321,572 | 5/1967 | Garner | 174/36 |
| 3,325,589 | 6/1967 | Mildner | 174/36 |
| 3,413,405 | 11/1968 | Myers | 174/36 |
| 3,497,383 | 2/1970 | Olyphant, Jr. et al. | 174/117 A |
| 3,505,144 | 4/1970 | Kilduff et al. | 174/117 A |
| 3,601,721 | 8/1971 | Justice | 174/109 X |
| 3,662,090 | 5/1972 | Grey | 174/102 R X |
| 4,041,237 | 8/1977 | Stine | 174/36 |
| 4,327,248 | 4/1982 | Campbell | 174/107 |
| 4,376,920 | 3/1983 | Smith | 174/36 X |
| 4,454,379 | 6/1984 | Cleveland et al. | 174/36 X |
| 4,461,076 | 7/1984 | Plummer | 174/36 X |
| 4,477,693 | 10/1984 | Krabec et al. | 174/36 |
| 4,488,125 | 12/1984 | Gentry | 174/115 X |
| 4,596,897 | 6/1986 | Gruhn | 174/36 |
| 4,598,165 | 7/1986 | Tsai | 174/36 |
| 4,626,810 | 12/1986 | Nixon | 174/110 F X |

*Primary Examiner*—Morris H. Nimmo

*Attorney, Agent, or Firm*—Salter & Michaelson

[57] ABSTRACT

A shielded electrical cable includes a central conductor wire, a dielectric core over the conductor wire, a metallic foil shielding tape over the dielectric core and an insulated outer jacket over the shielding tape. The shielding tape is wrapped on the dielectric core so that one edge portion of the tape overlaps the opposite edge portion thereof, and it includes a metallic layer and a waterproof adhesive layer on the inner side of the metallic layer. The adhesive layer extends over only preselected portions of the inner side of the metallic layer in the overlapping edge portion of the tape so that a plurality of spaced contact pads are provided on the inner side of the tape wherein the metallic layer is exposed. The adhesive layer bonds and seals the overlapping edge portions of the tape together, and metal-to-metal contact is effected between the inner and outer sides of the metallic layer in the contact pads to reduce radiation leakage between the overlapping edge portions of the tape.

15 Claims, 2 Drawing Sheets

SHIELDED ELECTRICAL CABLE CONSTRUCTION

BACKGROUND AND SUMMARY OF THE INVENTION

The instant invention relates to electrical cables and more particularly to an improved shielded electrical cable construction of a type which includes a shielding layer comprising a flexible metallic shielding tape.

The concept of shielding various electrical components against the ingress and egress of stray electrical currents or radiation is well known in the electronics industry. In this connection, shielded electrical cables comprising a metallic shielding layer for shielding against the ingress and egress of radiation are widely used for transmitting electrical signals in a broad range of applications. Cables of this type generally comprise an inner conductor wire, a dielectric core over the conductor wire, a shielding layer over the dielectric core, and an insulating outer jacket over the dielectric core. The shielding layers of most conventional shielded cables of this type generally comprise either a flexible layer of thin braided wire strands and/or a thin flexible metallic shielding tape, for example, a tape made of plastic film-foil laminate. Generally, it has been found that shielded cables including shielding layers of these types can be utilized for transmitting electrical signals so that they are less affected by electromagnetic radiation emanating from adjacent cables or other components and also so that they produce reduced quantities of radiation which can affect the signals transmitted through other cables or components.

However, while cables comprising shielding layers made from a plurality of thin braided wire strands are generally satisfactory for some applications, it has been found that the unavoidable inherent openings in braided shielding layers of cables of this type can be penetrated by radiation, particularly radiation which is produced by high frequency signals, for example, those signals which are often required for high speed communication of computer data. Further, it has been found that cables of this type are relatively susceptible to moisture penetration when they are utilized in exterior applications. Specifically, it has been found that once moisture has penetrated the outer jacket of a cable of this type, it can easily penetrate the braided shielding layer of the cable. Further, it has been found that once moisture has penetrated the shielding layer of a cable of this type, it has a tendency to be carried along the length of the cable via capillary action or wicking effects until the water eventually reaches a defect in the core where it can penetrate through to the conductor wire of the cable. Still further, it has generally been found that once moisture has penetrated through to the core of a cable in this manner, it can cause the cable to fail due to corrosion and/or short circuiting.

On the other hand, cables comprising shielding layers made from metallic shielding tapes have generally been found to be substantially less prone to passing stray electrical currents or radiation through the shielding layers thereof than cables comprising shielding layers made from braided wire strands. Generally, the shielding layers of cables of this type are formed by either spirally or longitudinally "cigarette" wrapping metallic foil tapes on the outer surfaces of the dielectric cores thereof. In many instances, the metallic foil shielding tapes utilized in cables of this type include waterproof adhesive layers on the inner surfaces thereof for adhesively securing them to the respective dielectric cores thereof. Further, generally when metallic foil tapes of this type are assembled on the dielectric cores of cables to form shielding layers thereon, they are assembled so that the opposite edge portions of the tapes overlap one another to form overlapping seams in order to minimize radiation leakage through the seam areas. However, it has also been found that when tapes having adhesive layers on the inner surfaces thereof are assembled in cables in this manner, the adhesive layers normally prevent metal-to-metal contact in the overlapping seam areas. Further, it has been found that the thicknesses of the adhesive layers of shielding tapes of this type can cause the metallic layers of such tapes to be spaced apart slightly in the overlapping seam areas thereof, and that although the spacings between the metallic layers in such seam areas are relatively small, they are nevertheless suffficient to provide paths which permit the ingress and egress of certain quantities of electromagnetic radiation. Nevertheless, it has generally been found that the use of adhesives to secure the edge portions of metallic foil tapes together in the overlapping seam areas of shielding layers is generally essential to prevent moisture penetration through shielding layers.

The instant invention provides a novel solution to the problem of minimizing the leakage of radiation through the overlapping seams areas of the shielding layers of cables comprising metallic foil shielding tapes. Specifically, the instant invention provides a shielded cable construction comprising an elongated conductor wire, a dielectric core over the conductor wire, and a metallic shielding tape over the dielectric core. The shielding tape includes opposite first and second edge portions, and it is wrapped over the dielectric core so that the second edge portion overlaps the first edge portion. Further, the shielding tape includes a metallic layer having inner and outer surfaces and an adhesive layer on preselected portions of the inner surface of the metallic layer in at least the second edge portion of the tape to define a plurality of slightly recessed, localized contact pads on the second edge portion of the tape wherein the metallic layer is exposed. The outer surface of the metallic layer is exposed in at least the first edge portion of the tape, and the inner surface of the second edge portion of the tape is bonded to the outer surface of the first edge portion so that the inner surface of the metallic layer contacts the outer surface of the metallic layer in at least a portion of the contact pads. The adhesive layer of the tape is preferably formed so that it provides a substantially continuous seal between the first and second edge portions of the tape in the overlapping seam area which extends along the longitudinal extent of the cable despite the presence of the contact pads in the seam area. Further, the contact pads are preferably formed so that they are of substantially uniform width and they are preferably oriented so that they are aligned in at least one substantially longitudinally extending row of contact pads which extends along the second edge portion of the tape. Further, the width of the overlapping portion of the tape is preferably greater than the width of the contact pads in the seam area so that an effective seal can be provided between the inner and outer surfaces of the tape in the overlapping seam area while nevertheless providing metal-to-metal contact between the inner and outer surfaces of the metallic layer in the contact pads. The contact pads on the metallic layer are preferably formed so that they have longitudinal and transverse dimensions which are at least five times the thickness of the adhesive in order to further assure that effective metal-to-metal contact is achieved between the inner and outer surfaces of the metallic layer in the contact pads. Further, the adhesive layer and the contact pads are preferably formed so that metal-to-metal contact between the inner and outer surfaces of the metallic layer is achieved along at least 10% of the length of the cable. A first embodiment of the shielded cable includes a single shielding layer comprising a metallic foil shielding tape, and a second embodiment of the cable includes a second braided wire shielding layer over the metallic foil shielding tape thereof. The shielded cable preferably further comprises an outer insulating jacket either directly over the metallic shielding tape or over the braided wire shielding layer, and the adhesive layer preferably extends over preselected portions of the entire inner surface of the metallic layer to bond and seal the metallic tape to the dielectric core. The metallic layer in the shielding tape can be effectively embodied as comprising a single metal sheet or a plurality of metal sheets with at least one plastic reinforcing film interposed therebetween.

Cables and shielding materials representing the closest prior art to the subject invention of which the applicant is aware are disclosed in the U.S. Pat. Nos. to CLUNE, #1,445,070; TIMMONS, #3,274,329; MYERS, #3,413,405; OLYPHANT, JR. et al, #3,497,383; KILDUFF et al, #3,505,144; ANGELE, #3,612,743; GREY, #3,662,090; SWEARINGEN et al, #3,770,570; STINE et al, #4,096,346; VERMA et al, #4,209,215 and GRUHN, #4,596,897 and the European patent to OLYPHANT JR., #0 061 829. However, these references fail to suggest the concept of providing an interrupted adhesive layer on portions of a metallic shielding tape in order to achieve metal-to-metal contact in the overlapping seam in a shielding layer while nevertheless providing an effective water-tight seal in the overlapping seam area. As a result, the above references are believed to be of only general interest with respect to the shielded cable of the subject invention.

Accordinlgy, it is a primary object of the instant invention to provide an improved shielded cable construction of a type which includes a shielding layer comprising a metallic foil tape.

Another object of the instant invention is to provide a shielded cable construction of a type which includes a shielding layer comprising a metallic shielding tape wherein overlapping portions of the shielding tape are adhesively secured together to form an overlapping seal and wherein metal-to-metal contact is nevertheless effected in the overlapping seal.

A still further object of the instant invention is to provide a shielded cable construction comprising a conductor wire, a dielectric core over the conductor wire, and a metallic foil shielding tape over the dielectric core wherein the shielding tape includes an adhesive layer on preselected portions thereof, wherein one edge portion of the shielding tape is adhesively secured in overlapping relation to the opposite edge portion thereof with the adhesive layer, and wherein a plurality of open contact patches are provided in the adhesive layer to effect metal-to-metal contact between the overlapping opposite edge portions of the tape.

Other objects, features and advantages of the invention shall become apparent as the description thereof proceeds when considered in connection with the accompanying illustrative drawings.

DESCRIPTION OF THE DRAWING

In the drawings which illustrate the best mode presently contemplated for carrying out the present invention.

DESCRIPTION OF THE INVENTION

Figure 4:
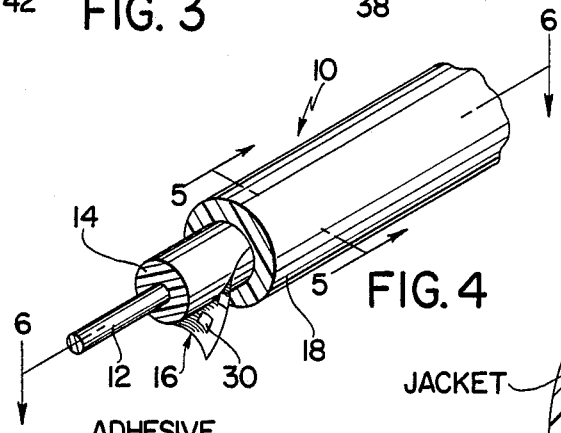
FIG. 4 is a perspective view of the shielded cable of the instant invention.
Figure 5:
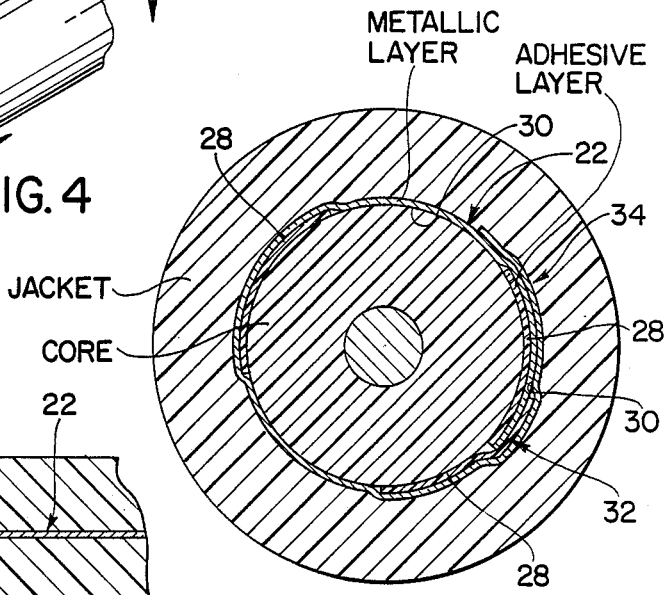
FIG. 5 is a sectional view taken along 5—5 in FIG. 4.
Figure 6:
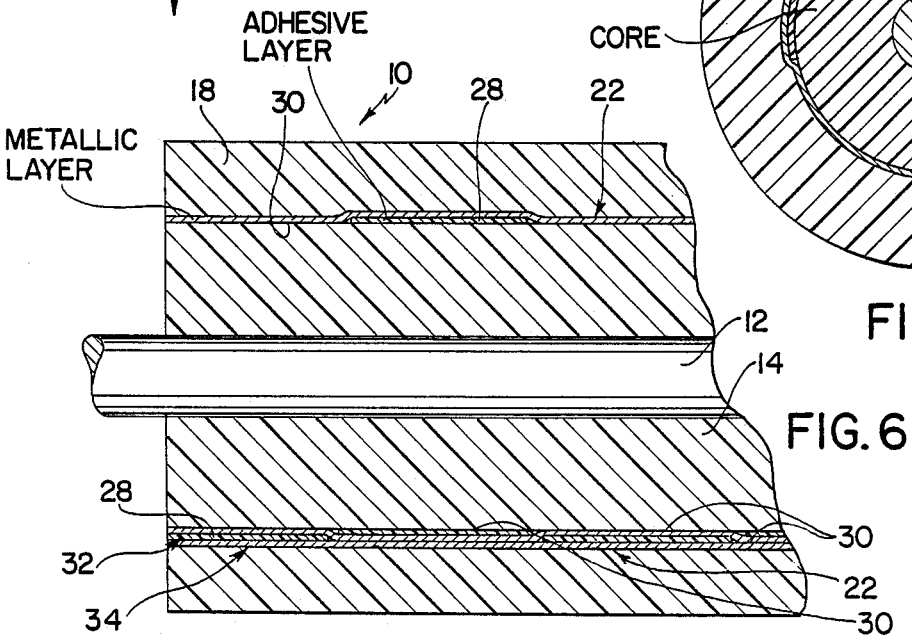
FIG. 6 is a sectional view taken along 6—6 in FIG. 4.
Figure 7:
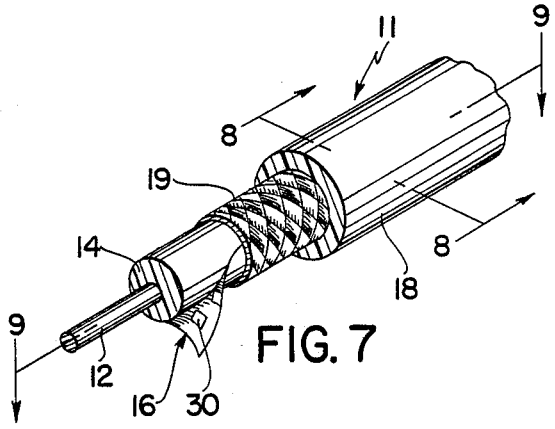
FIG. 7 is a perspective view of a second embodiment of the shielded cable of the instant invention.
Figure 8:
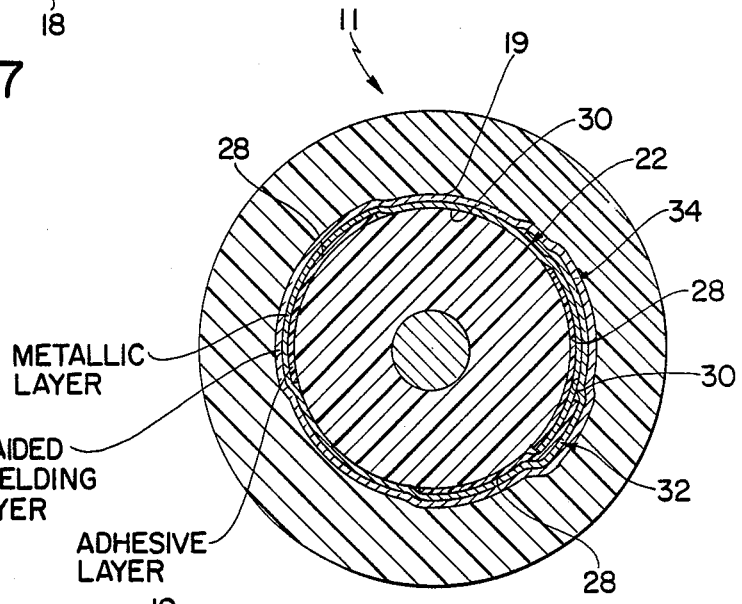
FIG. 8 is a sectional view taken along line 8—8 in FIG. 7.
Figure 9:
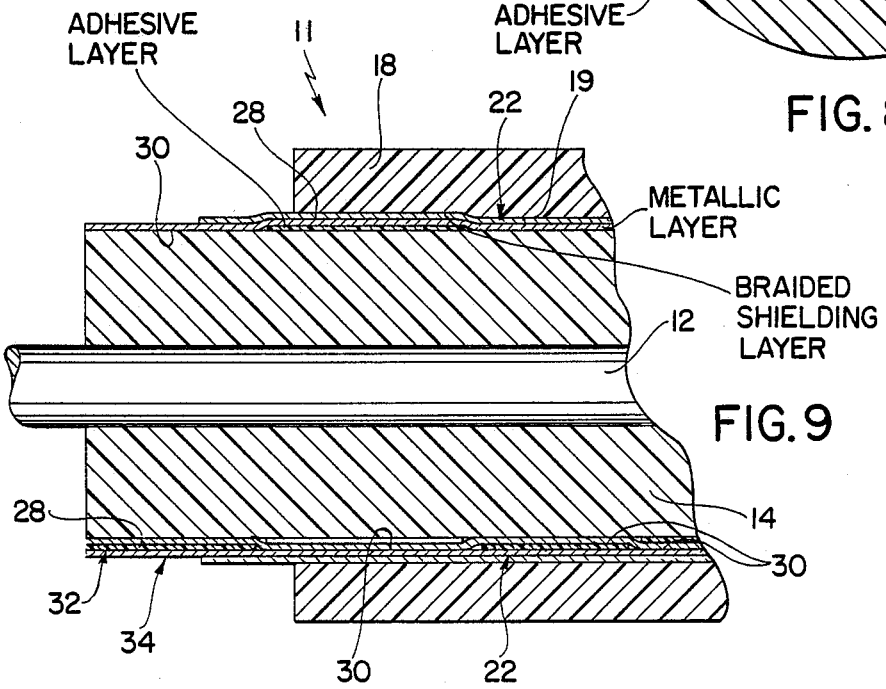
FIG. 9 is a sectional view taken along line 9—9 in FIG. 7.

Referring now to the drawings, a first embodiment of the shielded cable of the instant invention is illustrated in FIGS. 4–6 and generally indicated at 10, and a second embodiment of the shielded cable is illustrated in FIGS. 7–9 and generally indicated at 11. The cables 10 and 11 comprise conductor wires 12, dielectric cores 14 over the conductor wires 12 thereof, and shielding layers comprising metallic foil shielding tapes generally indicated at 16 over the dielectric cores 14 thereof. The cable 10 includes an insulating outer jacket 18 directly over the shielding tape 16 thereof, whereas the cable 11 includes a braided wire shielding layer 19 over the shielding tape 16 thereof and a jacket 18 over the shielding layer 19 thereof.

Referring first to the cable 10, the conductor wire 12 preferably comprises a conventional conductor wire made of a suitable electrically conductive material, such as copper or a known alloy, and it preferably has a diameter in the range of between 0.002 in. and 0.125 in. It will be understood, however, that other embodiments of the shielded cable of the instant invention which comprise conductor wires including a plurality of stranded filaments or which comprise a plurality of individually insulated central conductor wires are contemplated.

The core 14 of the cable 10 preferably comprises a suitable conventional flexible insulating plastic material which is extruded over the conductor wire 12 in a conventional cable manufacturing process.

The shielding tape 16 of the cable 10 is illustrated in FIGS. 1, 2 and 4–6, and it comprises a metallic layer generally indicated at 22 having inner and outer sides 24 and 26, respectively, and an adhesive layer 28 on the inner side 24 of the metallic layer 22. The metallic layer 22 preferably comprises a metallic foil sheet made from a suitable metal, such as aluminum, which has a high degree of electrical conductivity and which is also relatively ductile. The metallic layer 22 has a thickness in the range of between approximately 0.00005 in. and 0.010 in. and preferably between approximately 0.0002 in. and 0.004 in. The adhesive layer 28 preferably comprises a thermally activated adhesive, a pressure-sensitive adhesive, or a thermosetting adhesive, and it may include electrically conductive fibers or particles intermixed therein. The adhesive layer 28 has a thickness of between approximately 0.00035 in. and 0.0025 in. and preferably between 0.0001 in. and 0.0005 in., and it has been found that a thermally activated copolymer such as ethylene-acrylic acid (EAA) can be effectively utilized for the adhesive layer 28. The adhesive layer 28 is preferably applied to the metallic layer 22 via a printing process, for example, a Roto-Gravure printing process, during the manufacture of the tape 16, and it is applied to preselected portions of the inner surface 24 so that the adhesive layer 28 defines a plurality of longitudinally extending rows of spaced, slightly recessed, localized contact pads 30 on the inner surface of the tape 16. In this regard, the tape 16 has opposite longitudinally extending first and second side edge portions generally indicated at 32 and 34, respectively, adjacent the opposite longitudinally extending edges thereof. The adhesive layer 28 is applied to the inner surface 24 of the metallic layer 22 so that it extends over at least the second edge portion 34 of the tape 16 and so that a plurality of the contact pads 30 are disposed in at least one longitudinally extending row in the second edge portion 34 of the tape 16. Further, when the contact pads 30 are disposed in more than one row, the adjacent pads 30 are preferably spaced by at least approximately one-half the width of one contact pad 30. The second side 26 of the metallic layer 22 is exposed so that it defines the outer surface of the tape 16 in at least the first edge portion 32.

The tape 16 is assembled in the cable 10 by passing it through a series of guides so that it is received and formed over the core 14 with the adhesive layer 28 facing inwardly to bond and seal the tape 16 to the core 14. Further, the tape 16 is assembled so that the second edge portion 34 thereof overlaps the first edge portion 32 in order to form an overlapping seam in the shielding layer and to completely enclose the core 14 with the tape 16. In the cable 10, the tape 16 is longitudinally or "cigarette" wrapped on the core 14, although other embodiments of the cable of the instant invention wherein shielding tapes are spirally or helically wrapped on dielectric cores are contemplated. The adhesive layer 28 in the second edge portion 34 is provided for bonding and sealing the inner surface of the second edge portion 34 of the tape 16 to the outer surface of the first edge portion 32. In this regard, as illustrated in FIGS. 5 and 6, when the tape 16 is assembled in the cable 10, portions of the metallic layer 22 which are located in the contact pads 30 disposed in the second edge portion 34 of the tape 16 make metal-to-metal contact with the outer surface 26 of the metallic layer 22 in the seam area where the second edge portion 34 overlaps the first edge portion 32. The tape 16 is preferably constructed so that the longitudinal and transverse dimensions of the contact pads 30 are at least five times as great as the maximum thickness of the adhesive layer 28 in order to achieve effective metal-to-metal contact between the inner surface 24 and the outer surface 26 in the contact pads 30 located in the overlapping edge portions of the tape 16. Since the metallic layer 22 is relatively flexible and since the adhesive layer 28 is relatively thin, effective metal-to-metal contact is normally achieved in the overlapping seam area due to slight collapsing of the metallic layer in the contact pads 30 and/or the preferably cylindrical configuration of the cable 10. The tape 16 is preferably further constructed so that the contact pads are of substantially uniform dimension and so that the width of the seam area where the second edge portion 34 overlaps the first edge portion 32 is greater than the width of the contact pads 30 to assure that the adhesive layer 28 nevertheless provides a seal between the first and second edge portions 32 and 34, respectively, which is substantially continuous over the longidutinal extent of the cable 10. Further, the contact pads 30 are preferably oriented so that metal-to-metal contact is achieved between the first surface 24 and the second surface 26 along at least approximately 10% of the longitudinal extent of the cable 10.

The jacket 18 is preferably extruded over the tape 16 from a suitable flexible and durable insulating plastic material of conventional construction. In many instances, when the adhesive layer 28 comprises a thermally activated adhesive, the heat of the extrusion process utilized for applying the outer jacket 18 is sufficient to activate the adhesive in the layer 28 to secure the tape 16 to the core 14, although in some cases it is preferable to preheat the tape 16 before the jacket 18 is applied.

The shielded cable 11 is illustrated in FIGS. 7-9, and it comprises a conductor wire 12, a core 14, a metallic foil shielding tape 16 and an outer jacket 18, all of which are similar to their corresponding components in the cable 10. However, the cable 11 further comprises a braided wire shielding layer 19 over the shielding tape 16 thereof to provide an increased shielding effect. The shielding layer 19 preferably comprises a plurality of thin wires which are formed in a hollow braid pattern over the tape 16 thereof. The jacket 18 in the cable 11 is extruded over the shielding layer 19 to provide an outer insulating jacket in the cable 11.

Figure 1:
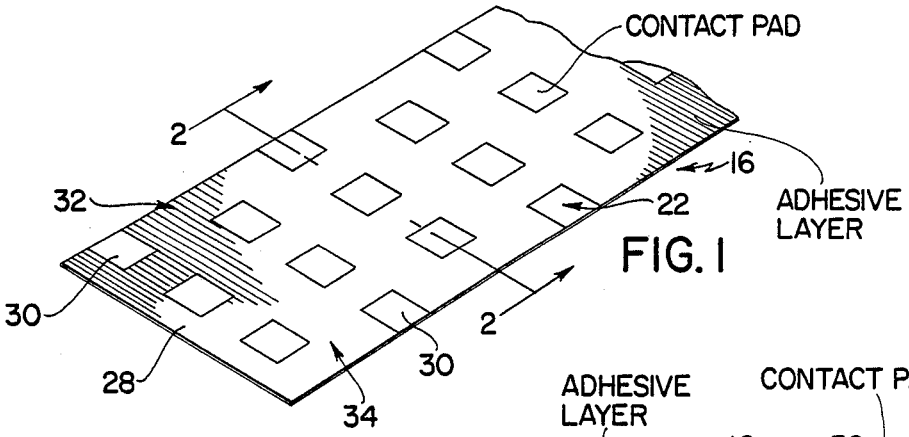
FIG. 1 is a perspective view of a metallic shielding tape of a type utilized in the shielded cable of the instant invention.
Figure 2:
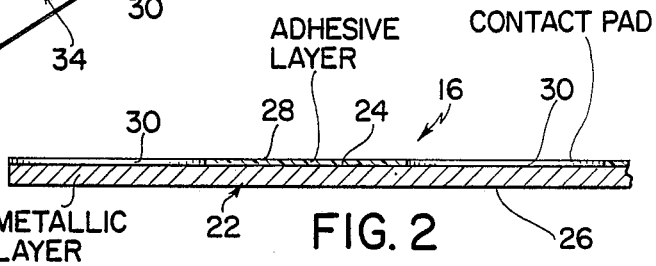
FIG. 2 is a sectional view taken along line 2—2 in FIG. 1.
Figure 3:
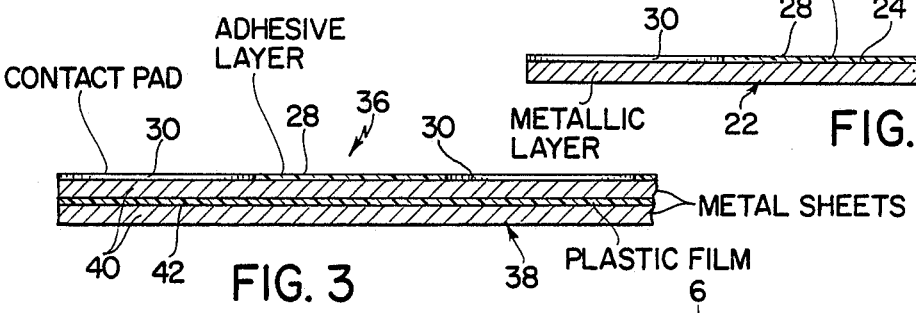
FIG. 3 is a similar sectional view of another embodiment of the shielding tape.

An alternative embodiment of the shileding tape which can be utilized in the shielded cable of the instant invention is illustrated in FIG. 3 and generally indicated at 36. The tape 36 comprises a metallic layer 38 comprising a pair of metal sheets 40 which are preferably also made of aluminum or some other suitable electrically conductive material, and a plastic film 42 which is interposed between the sheets 40. The film 42 preferably has a thickness of between approximately 0.00035 in. and 0.0035 in. and it is preferably made of a suitable durable and flexible plastic material, such as a polyester, a polyolefin, a polyolefin copolymer, a polyamide, polyimide or polycarbonate. The sheets 40 preferably have thicknesses which are in the range of between approximately 0.0002 in. and 0.004 in. and they are adhesively secured to the film 42. The tape 36 further comprises an adhesive layer 28 thereon which is similar to the adhesive layer 28 in the tape 16 and which defines a plurality of contact pads 30 on one side of the tape 36. The tape 36 can be effectively assembled in a shielded cable in a manner similar to that hereinabove described with respect to the tape 16 in the cable 10.

It is seen therefore that the instant invention provides an effective shielded cable construction which is resistant to water penetration and has improved shielding characteristics. Specifically, the cables 10 and 11 are constructed so that the metal-to-metal contact is achieved between the inner and outer surfaces 24 and 26, respectively, of the metallic layers 22 thereof where the second edge portions 34 overlap the first edge portions 32 to provide effective barriers against the ingress and egress of electromagnetic radiation through the overlapping seam areas of the tapes 16. More specifically, the tapes 16 are constructed so that metal-to-metal contact is achieved in the contact pads 30 located in the overlapping seam areas of the tapes 16. However, despite the fact that the contact pads 30 provide metal-to-metal contact in the seam areas to increase the shielding effects of the tapes 16, the adhesive layers 28 provide effective seals in the overlapping seam areas which substantially prevent the penetration of moisture through the shielding layers formed by the tapes 16. Further, the portions of the adhesive layers 28 which are bondd to the cores 14 provide additional resistance to moisture penetration in the cables 10 and 11, and they prevent moisture from traveling longitudinally therein. Accordingly, for these reasons as well as the other reasons hereinabove set forth, it is seen that the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A shielded cable comprising an elongated conductor wire, a dielectric core over said conductor wire, and a metallic shielding tape over said core, said shielding tape having opposite longitudinally extending first and second edge portions adjacent opposite longitudinally extending first and second edges thereof, respectively, said shielding tape being wrapped over said core so that the second edge portion of said tape overlaps the first edge portion thereof, said tape comprising a metallic layer extending substantially across the width of said tape and having substantially smooth inner and outer metallic surfaces, and an adhesive layer preprinted on preselected portions of the inner surface of said metallic layer in said second edge portion to define a plurality of localized metallic contact pads thereon where the inner surface of said metallic layer is not coated by said adhesive layer, the outer surface of said metallic layer substantially defining the outer surface of said tape in said first edge portion, said adhesive bonding said second edge portion to said first edge portion, the inner surface of said metallic layer contacting the outer surface of said metallic layer in at least a portion of said contact pads.

2. In the shield cable of claim 1, said contact pads further characterized as discrete spaced contact pads.

3. In the shielded cable of claim 2, said adhesive forming a seal between said first and second edge portions which is substantially continuous in the longitudinal extent of said cable.

4. In the shielded cable of claim 2, said contact pads being of substantially uniform width and defining at least one longitudinally extending row of spaced contact pads, the width of said overlapping second edge portion being greater than the width of said contact pads in said row.

5. The shielded cable of claim 1 further comprising an outer insulating jacket over said metallic shielding tape.

6. In the shielded cable of claim 1, said adhesive layer extending over preselected portions of the entire inner surface of said metallic layer.

7. In the shielded cable of claim 6, said adhesive layer bonding said metallic shielding tape to said dielectric core.

8. The shielded cable of claim 7 further comprising an outer insulating jacket.

9. In the shielded cable of claim 1, said adhesive layer extending over preselected portions of substantially the entire inner surface of said metallic layer, said contact pads being of substantially uniform width and defining a plurality of rows of spaced contact pads, said rows being spaced by at least approximately one-half the width of said contact pads, the width of said overlapping second edge portion being greater than the width of said contact pads.

10. In the shielded cable of claim 1, said metallic layer comprising first and second metal sheets, and a plastic film interposed between said sheets.

11. In the sheilded cable of claim 1, said contact pads having longitudinal and transverse dimensions with respect to said tape which are at least five times the thickness of said adhesive layer.

12. In the shielded cable of claim 1, the inner surface of said metallic layer contacting the outer surface of said metallic layer in said contact pads laong at least 10% of the longitudinal extent of said cable.

13. The shielded cable of claim 1 further comprising a braided wire shielding layer over said metallic shielding tape.

14. The shielded cable of claim 13 further comprising an outer insulating jacket over said braided wire shielding layer.

15. A shielded cable comprising an elongated conductor wire, a dielectric core over said conductor wire, and a metallic shielding tape over said core, said shielding tape having opposite longitudinally extending first and second edge portions adjacent opposite longitudinally extending first and second edges thereof, respectively, said shielding tape being wrapped over said core so that the second edge portion of said tape overlaps the first edge portion thereof, said tape comprising a metallic layer extending substantially across the width of said tape and having substantially smooth inner and outer metallic surfaces, and an adhesive layer between the inner surface of the portion of said metallic layer in said second edge portion and the outer surface of the portion of said metallic layer in said first edge portion, said adhesive layer being preprinted on the portion of said metallic layer in one of said first or second edge portions to define a plurality of localized metallic contact pads thereon where said metallic layer is not coated by said adhesive layer, said adhesive layer bonding said second edge portion to said first edge portion, the inner and outer surfaces of said metallic layer contacting each other in at least a portion of said contact pads.

* * * * *